US005560485A

United States Patent [19]

O'Hara, Jr.

[11] Patent Number: 5,560,485

[45] Date of Patent: Oct. 1, 1996

[54] LOCKING HOOD FOR A GOLF BAG

[76] Inventor: John M. O'Hara, Jr., 931 Nichols Dr., Laurel, Md. 20707

[21] Appl. No.: 419,183

[22] Filed: Apr. 10, 1995

[51] Int. Cl.[6] ..... A63B 55/00

[52] U.S. Cl. ..... 206/315.4; 150/159; 70/2; 70/58

[58] Field of Search ..... 206/315.4, 315.6; 150/159, 160; 70/2, 6, 57, 58; 24/69 R, 69 ST, 69 CF; 292/256.6

[56] References Cited

U.S. PATENT DOCUMENTS

| | | | |
|---|---|---|---|
| 1,788,478 | 1/1931 | Beaty et al. | 206/315.6 |
| 4,712,394 | 12/1987 | Bull | 70/58 X |
| 4,752,004 | 6/1988 | Very | 206/315.4 |
| 5,005,623 | 4/1991 | Webster, Jr. | 206/315.4 |
| 5,131,442 | 7/1992 | Bevier | 206/315.4 |
| 5,177,986 | 1/1993 | Jensen | 70/58 X |
| 5,209,280 | 5/1993 | Gevas | 206/315.4 |
| 5,220,950 | 6/1993 | Cordasco | 206/315.4 |

*Primary Examiner*—Allan N. Shoap
*Assistant Examiner*—Christopher J. McDonald
*Attorney, Agent, or Firm*—Robert Halper

[57] ABSTRACT

A cylindrical hood made of water resistant, durable heavy duty material and designed to fit over a golf bag container, the hood containing a security device that includes a steel ribbon connected to a band at each end and sewn into the hood near its base with an adjustable clip fastened to one end of the band and a hasp fastened to the other end of the band, the clip under tension latching onto a tongue on the hasp and the hasp fitting over a staple through which a cable is inserted, passed around a static fixture and secured with a padlock.

8 Claims, 2 Drawing Sheets

FIG. 1
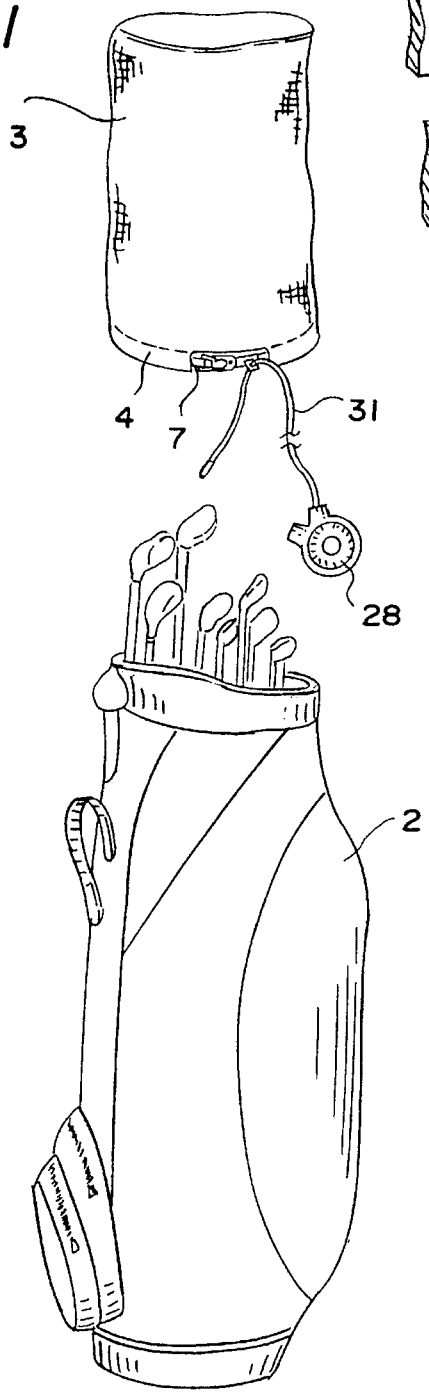
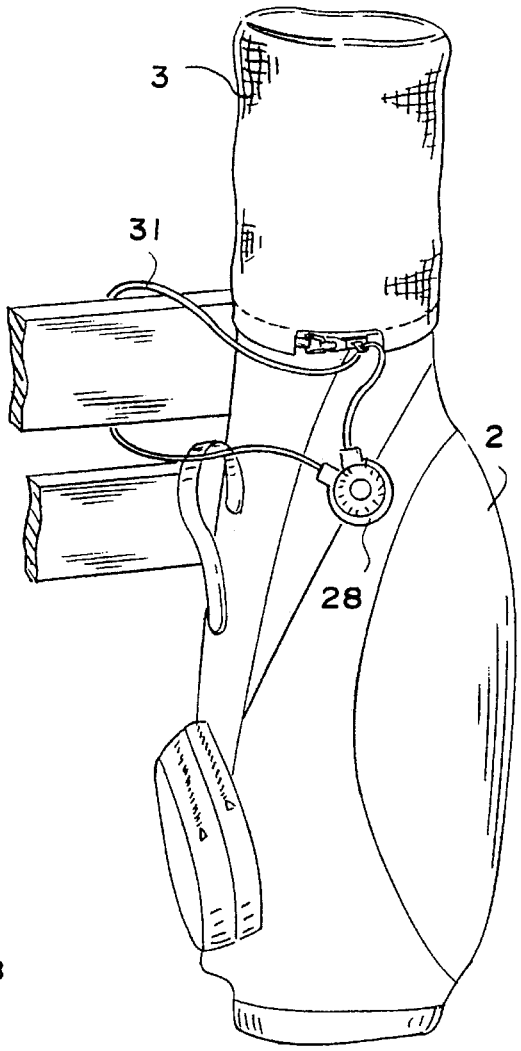
FIG. 3

LOCKING HOOD FOR A GOLF BAG

FIELD OF THE INVENTION

This invention relates to golf bags and their accompanying clubs, and its purpose is to provide a deterrent to theft of the equipment either at a golf course or while in transit such as by air, rail or bus.

BACKGROUND OF THE INVENTION

U.S. Pat. No. 1,307,966 is an automatic hasp lock which can be used on mail sacks. A strap is shown wrapped around a bag. Over the strap is a hinged plate that has a key hole and a bolt that comprises a key operated member and a locking member.

U.S. Pat. No. 4,078,594 shows a container for golf clubs wherein a tubular body portion of the bag is slidable in a telescopic arrangement so that the body portion can cover the clubs or expose the clubs. When covered a hinged lid is placed over the slidable body portion. A lid is also placed at the bottom of the bag and both lids are provided with locks.

U.S. Pat. No. 4,296,787 teaches a fastening and connecting device for a plurality of golf club head covers. An elongate cord cooperates with a plurality of coil springs to interconnect the covers. The coil sleeves are sleeved over the cord and extend between adjacent eyelets to prevent cord entanglement.

U.S. Pat. No. 4,863,019 shows a golf bag lock that comprises a pair of rigid arm members that grip the clubs. A rear mount has a base secured to a a golf bag and an extension member is hingedly mounted to the base. The arm members are also hingedly mounted to the extension member so that the arms can swing over and away from the mouth of the golf bag. The front mount also has a lockring. The free ends of the arms have apertures through which a lock can be placed to lock the arms to the front mount.

U.S. Pat. No. 4,961,447 teaches a golf bag container comprising a short upper body and a longer lower body. The open end of the short body is received in the open end of the larger body. The upper body is inserted so that the golf bags can be stored. The bodies are equipped with latches for holding them together. The bodies are made of a tough semi-rigid plastic to withstand the rigors of shipment.

U.S. Pat. No. 5,004,100 teaches a golf bag with a security device, wherein clubs are in a plate having a plurality of slots. A U-shaped arm secures the clubs in the slots and a padlock with a cable end locks the arms in place and the other end of the cable is wrapped around a tree or pole.

U.S. Pat. No. 5,071,147 is a box-like device for protectively storing and transporting golf equipment. The box is compartmentalized so as to keep the clubs separated. The box cover is hinged and there is a release mechanism for opening the cover. The deive is made of durable, waterproof plastic, metal or wood and is mounted on wheels for easy transport.

U.S. Pat. 5,191,978 shows a locker for storing golf club bags and a golf cart. To guard against falling out of the bags when the locker doors are opened, the lockers have downwardly slanted bottoms.

The art shows that there are security systems for locking clubs to golf bags or enclosing individual clubs in locked golf covers. It is also known to lock a plate that secures the golf clubs to a pole. It is also known to provide hoods to protect golf clubs as well as making sturdy bags that can survive transport without damage. None of these devices provide for both a protective cover for the clubs and a security device that prevents both clubs and bag from being stolen. The devices that lock the clubs in the bag, while no doubt effective, require expensive plates or arms to be attached to the bag with special mountings. The bags that have hoods are too rigid or are fitted in a telescopic arrangement that would militate adaptation to most existent golf bags.

It is an object of this invention to secure the hood of a golf bag so that once locked in position, the hood can not be removed without tools.

It is still an object of this invention to to provide a hood that is adaptable to present golf bags in use without any major modifications.

It is an additional object of this invention to not only lock the hood to the bag but also secure the the golf bag assembly to a static fixture so that the bag assembly can not readily be removed.

It is a further object of this invention to use a quick releasable clip so as to separate the hood from the golf bag container.

BRIEF DESCRIPTION OF THE DRAWINGS

FIG. 1 is a perspective view of the elements of the golf bag assembly.

FIG. 3 is a perspective view showing the golf bag assembly secured to a fence.

SUMMARY OF THE INVENTION

Figure 2:
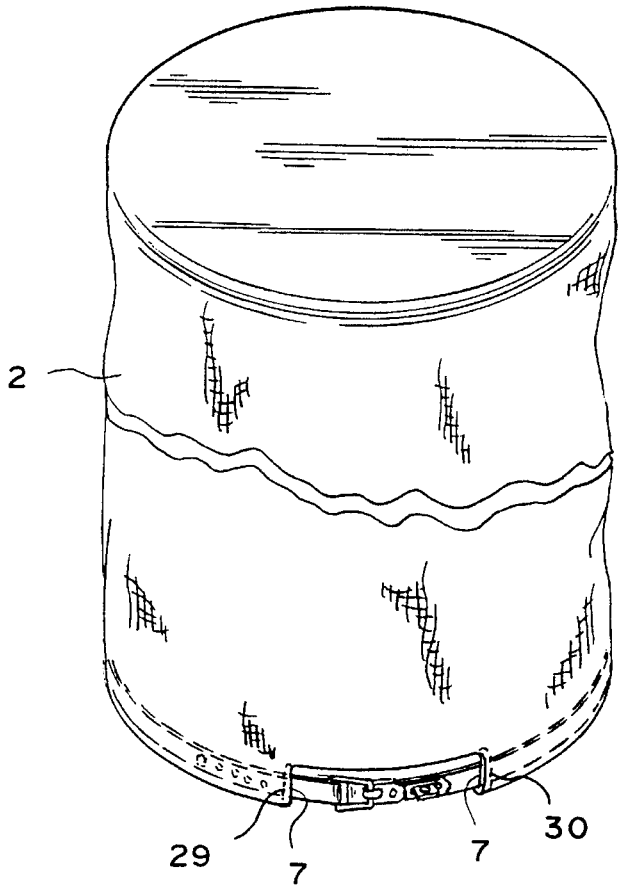
FIG. 2 is an enlarged perspective view showing showing the hood with its quick release clip.
Figure 4:
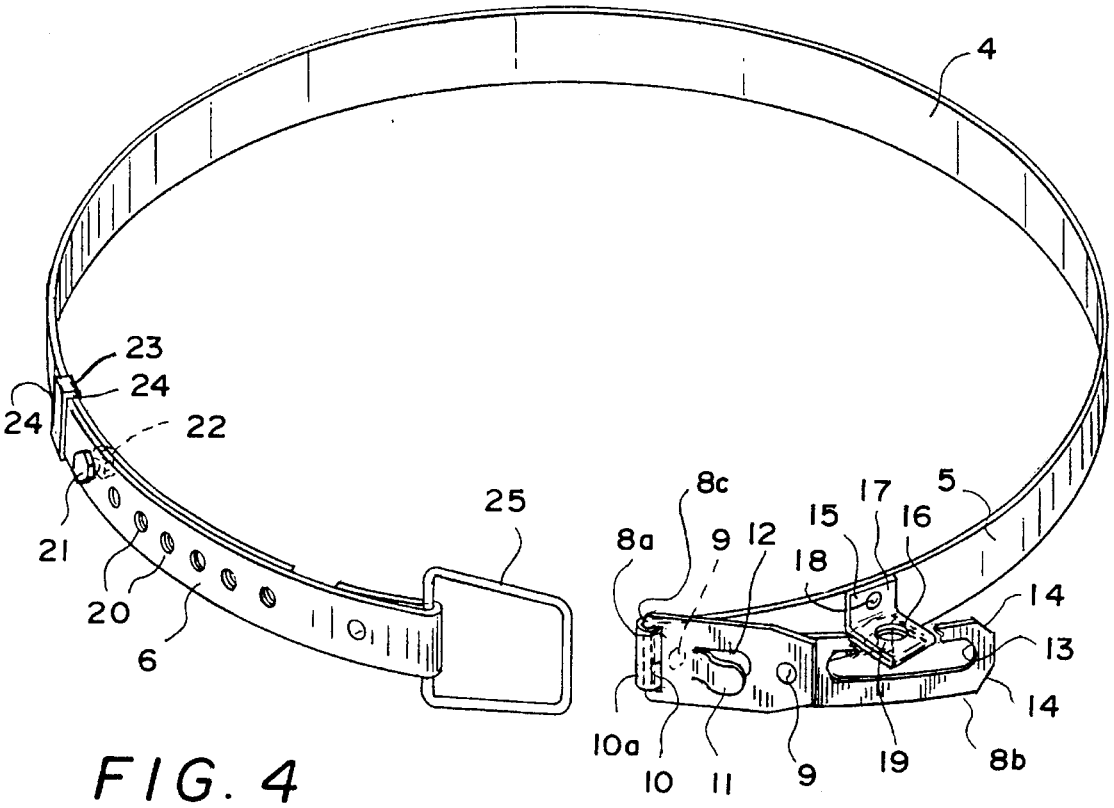
FIG. 4 is an enlarged view of the security device.

The golf bag in this invention is made of a durable, heavy duty, flexible material and is provided with conventional accessories such as a handle or strap, zippered pockets for balls, score cards, etc. The essence of the invention is a flexible hood that can be adapted to a variety of golf bag openings. Sewn inside the base of the hood is a metal ribbon. This ribbon extends through two opposing slots in the hood. At one end of the ribbon there is attached a hasp in the form of a hinged band having a slot that fits over a staple riveted to the metal ribbon. At the other end of the ribbon there is fastened a quick release clip. The clip engages a raised portion in the hasp and then one segment of a cable is inserted through the staple and passed around a static fixture and into a lock. The clip, under considerable tension, can not be opened until the cable is released from the lock. Then with a forward motion toward the hasp, the clip can be swung open.

DETAILED DESCRIPTION OF THE INVENTION

FIG. 1 shows a golf bag assembly 1 comprising a bag 2 for containing golf clubs and accessories. A hood 3 is to fit neatly over the opening of the bag and is of a height that will accommodate the clubs without contact with their heads. Generally the height of the hood is 16 inches, the diameter of the hood opening is 9.5 inches, while that of the bag in unlocked condition is about 8.5 inches. As explained below, however, the security device is designed to accommodate other size hoods and containers also. The hood is made of a water resistant, heavy duty vinyl and canvas backed fabric sold under respective Trade Names, cordura or naugahyde.

Sewn inside near the base of the hood is a steel ribbon 4 about ⅝ inches wide and about 0.020"–0.022" gauge. Linked to each end of the ribbon are short bands 5 and 6. These bands extend through opposing slots 7 in the hood. Band 5 is in the form of a hasp having a hinged segment 8*a* connected to segment 8*b* by a rivet 9. Hinged segment 8*a* hinge 8*c* has a narrow slit 10 through which the end of the ribbon is inserted and bent back over hinge 8*c* to form a loop 10*a* with an extended end that is secured to an adjacent ribbon section by another rivet 9. The hinged segment has a tongue 10*a* raised above an incision 12 in the band. Segment 8*b* has an elongate slot 13 and clipped beveled edges 14. Spaced inwardly a short distance from loop 11 is a staple in the form of a T shaped strip 15 wherein the leg 16 of the T extends horizontally outward from the ribbon and its flanges 17 cover the width of the ribbon with each flange being riveted thereto with rivet 18. The leg of the T has a perforation 19 and the leg is in alignment with band 5 such that when the band is pivoted back about the ribbon the elongate slot of segment 8*b* will fit over the leg of the T and the raised tongue will be facing toward the aforesaid aligned elements. Band 6 is somewhat longer than band 5 and it contains a plurality of perforations 20 which can coincide with similar type perforations in the ribbon. The band and ribbon are joined by passing a bolt 21 through the desired perforations and fastening with a nut 22. To prevent shifting of the band with respect to the ribbon the ribbon is enclosed by a small rectangular envelope 23 having two adjacent edges 24. To adjust the length of the band, it is slid through the envelope until the desired length is achieved and then the bolt and nut secure the band and ribbon at the perforation. A clip 25 shaped like a trapezoid is fastened to the band in the same manner as the hinged section 8*a* is fastened to the other end of the ribbon with the wider side of the trapezoid being enclosed by the loop. A cable 31 about 2 to 3 feet long has one end thereof passing through the perforation in the staple and as shown in FIG. 3 has its other end passing around a static fixture such as a fence and then both ends are passed into a padlock 28 and locked in place. When securing the golf bag, tension is applied to pull the free end of the clip so that it passes over the tongue. Then the cable is passed through the staple and locked in place. In locked position the base diameter is reduced to about 8 inches so that it would not be possible to raise the clip to open the bag until the cable is unlocked. When the cable is unlocked the clip is quickly releasable by pulling the cable toward the hinge. Because of the tension exerted, the area around the slots can be reenforced with a stitched lining 29 or a metal liner 30 that can be pressed into the slot.

The hood with its security device is susceptible to various modifications that would be obvious to the skilled artisan. Thus it should be understood that such changes in detail could be made without departing from the spirit and scope of the invention as defined by the following claims.

I claim:

1. A golf bag assembly comprising:

a) a golf club container and a water resistant, durable, heavy duty, cylindrical hood that fits snugly over an opening of said container, said hood extending over golf clubs in said container in a non-contacting relationship, b) said hood having a base and a pair of opposing slots in said hood above said base a steel ribbon sewn in said hood having ends, metal bands linked to said one and another of said ribbon ends and passing through said opposing slots so as to face each other, one of said bands devolving into a loop, c) a releasable clip enclosed by said loop and having a free side, d) the other of said bands being in the form of a hasp having a hinged segment riveted to a second segment having an elongated slot, means for fastening said hinged segment to one of said ribbon ends, a raised tongue cut out from said hinged segment, spaced from one of said ribbon ends, e) a staple riveted to said ribbon, spaced inwardly of said hinged segment and projecting horizontally from said ribbon, said staple having a perforation, said second segment being aligned with said staple so that said elongate slot in said second segment passes over said staple, when said hasp is hingedly folded back over said ribbon, f) a metal cable having one end inserted through said perforation in said staple and wrapped around a static fixture, said one end and another end of said cable being inserted into a padlock.

2. The golf bag assembly of claim 1 wherein said clip is in the form of a trapezoid having its long side enclosed by said loop, said loop facing toward said raised tongue when said second segment of said hasp passes over said staple.

3. The golf bag assembly of claim 1 wherein the means for fastening said hinged segment comprises a slit in said segment enclosed by a loop formed by passing said one ribbon end through said slit and fastening its extension to the remainder of the ribbon with a rivet.

4. The golf bag assembly of claim 1 wherein the staple is a T- shaped strip with flanges riveted to said ribbons and a horizontal leg projecting outwardly from said ribbon.

5. A golf assembly as in claim 1 wherein said opposing slots have a reenforcing liner stitched around said slots.

6. A golf assembly as in claim 1 wherein said cylindrical hood is about 16 inches in height and 9.5 inches diameter opening and said container has an 8.5 inches diameter opening in an unlocked condition with said hood enclosing said container and clip open and said diameter is about 8 inches when the clip is closed about said hood and said container and lock with said cable is in place.

7. A golf assembly as in claim 1 wherein said ribbon is about ⅝" wide, about 0.020–0.022" gauge thickness and said hood is made from a vinyl coated fabric.

8. A golf assembly as in claim 1 wherein said one of said bands contains a series of perforations and said ribbon has a number of matching perforations, a rectangular envelope enclosing said ribbon and containing ample space to allow said band to slide into said envelope a required distance so that one of said perforations of said band is aligned with a matching perforation on said ribbon and a nut and a bolt for fastening said band and said ribbon at said aligned perforations.

* * * * *